US006578501B1

(12) United States Patent
Moore

(10) Patent No.: US 6,578,501 B1
(45) **Date of Patent: *Jun. 17, 2003**

(54) NON-SWIVELING HEIGHT ADJUSTABLE PODIUM WITH PIN

(75) Inventor: Lorraine Moore, 1111 E. 9th, Cameron, TX (US) 76520

(73) Assignee: Lorraine Moore, Temple, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/898,405

(22) Filed: Jul. 3, 2001

Related U.S. Application Data

(63) Continuation-in-part of application No. 09/815,424, filed on Mar. 22, 2001.

(51) Int. Cl.[7] ..... A47B 9/20
(52) U.S. Cl. ..... 108/147; 108/147.19
(58) Field of Search ..... 108/147, 144.11, 108/50.01, 147.19, 95; 248/404, 161, 157, 188.5, 188.2

(56) References Cited

U.S. PATENT DOCUMENTS 4,166,926 A * 9/1979 Sieler
4,381,714 A 5/1983 Henneberg et al. ..... 108/147
4,735,469 A * 4/1988 Liggett
4,784,382 A * 11/1988 Myers
5,078,351 A 1/1992 Gualtieri ..... 248/161
5,078,414 A * 1/1992 Court et al.
5,287,815 A * 2/1994 Gross
5,806,943 A * 9/1998 Dell et al.
5,868,079 A * 2/1999 Charny
5,884,882 A * 3/1999 Nada et al.
6,003,452 A * 12/1999 Moore
6,092,474 A * 7/2000 Chen
6,158,357 A * 12/2000 Shih
6,182,583 B1 * 2/2001 Larson

FOREIGN PATENT DOCUMENTS

DE 2649868 * 5/1978
WO WO 00/21414 4/2000 ..... A47C/3/30

* cited by examiner

*Primary Examiner*—Jose V. Chen
(74) *Attorney, Agent, or Firm*—Wendy K. B. Buskop; Buskop Law Group, P.C.

(57) ABSTRACT

A non-swiveling height adjustable podium comprising a base, a column, a cam locking pneumatic cylinder disposed within the column; a receiver tube having a first tube end slidingly disposed over a first end, and a second tube end; a top mount assembly having a right side, a left side, a front side, a speaker side, a top side, a bottom side, a receiver tube engaging structure secured to the bottom side for fixedly connecting the receiver tube to the top mount assembly, a top shelf having a sloping portion and a flat portion, and wherein the sloping portion is secured to the top mount assembly; a front panel secured to the front side and the flat portion; a support structure having a first part fixed to and extending from a position between the first tube end of the receiver tube and the second end of the receiving tube to a second part secured to the front panel; a left panel secured to the left side and to the front panel; a right panel secured to the right side and the front panel; an actuation structure for engaging the pneumatic cylinder; a cam locking structure for locking the podium at a desired height once the pneumatic cylinder is engaged, and a locking pin for arresting swiveling movement of the receiver tube.

11 Claims, 4 Drawing Sheets

NON-SWIVELING HEIGHT ADJUSTABLE PODIUM WITH PIN

BACKGROUND OF THE INVENTION

The present application is a continuation-in-part application of patent application Ser. No. 09/815,424, filed with the United States Patent and Trademark Office on Mar. 22, 2001.

The present invention was conceived because most height adjustable podiums are either spring loaded or manually adjustable making it impossible for a handicapped or elderly person to adjust a podium for their use. Additionally, most height adjustable podiums are of the swivel type which then require a complex locking or camming mechanism that not only adds to the expense of production for the podiums but also adds to the shipping weight of the unit. Examples of chair base inventions of this type with spring mechanisms can be seen in U.S. Pat. No. 5,078,351. Mechanical mechanisms for adjustable height tables can be viewed in U.S. Pat. No. 4,381,714. In this reference, the problems of structural support for an adjustable height table were handled with bracing mechanisms that could be extended. Various other telescoping mechanisms have been addressed in pending published PCT case, International No. WO 00/21414 with the International Publication date of Apr. 20, 2000. None of the references handle the non-swiveling aspects for a podium specifically, without adding weight to the structure, through additional swivel dampening means.

SUMMARY OF THE INVENTION

A non-swiveling height adjustable podium comprising a base, a column, a pneumatic cylinder disposed within the column; a receiver tube having a first tube end slidingly disposed over a first end, and a second tube end; a top mount assembly having a right side, a left side, a front side, a speaker side, a top side, a bottom side, a receiver tube engaging means secured to the bottom side for fixedly connecting the receiver tube to the top mount assembly, a top shelf having a sloping portion and a flat portion, and a flat middle shell secured to the top mount assembly; a front panel secured to the front side and said flat portion; a support means having a first part fixed to and extending from a position between the first tube end of the receiver tube and the second end of the receiving tube to a second part secured to the front panel; a left panel secured to the left side and to the front panel; a right panel secured to the right side and the front panel; an actuation means for engaging the pneumatic cylinder; a locking means for locking the podium at a desired height once the pneumatic cylinder is engaged, and a locking pin for arresting swiveling movement of the receiver tube.

The invention and its objects and advantages will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

The present invention will be directed in particular to elements forming part of, or cooperating more directly with, an apparatus in accordance with the present invention.

It is to be understood that elements not specifically shown or described may take various forms well known to those skilled in the art. For the sake of discussion, but not limited thereto, the preferred embodiments of the present invention will be illustrated in relation to a pneumatic podium with adjustable heights. The present invention is not limited to an adult pneumatic podium, but can incorporate a child size version as well.

Figure 1:
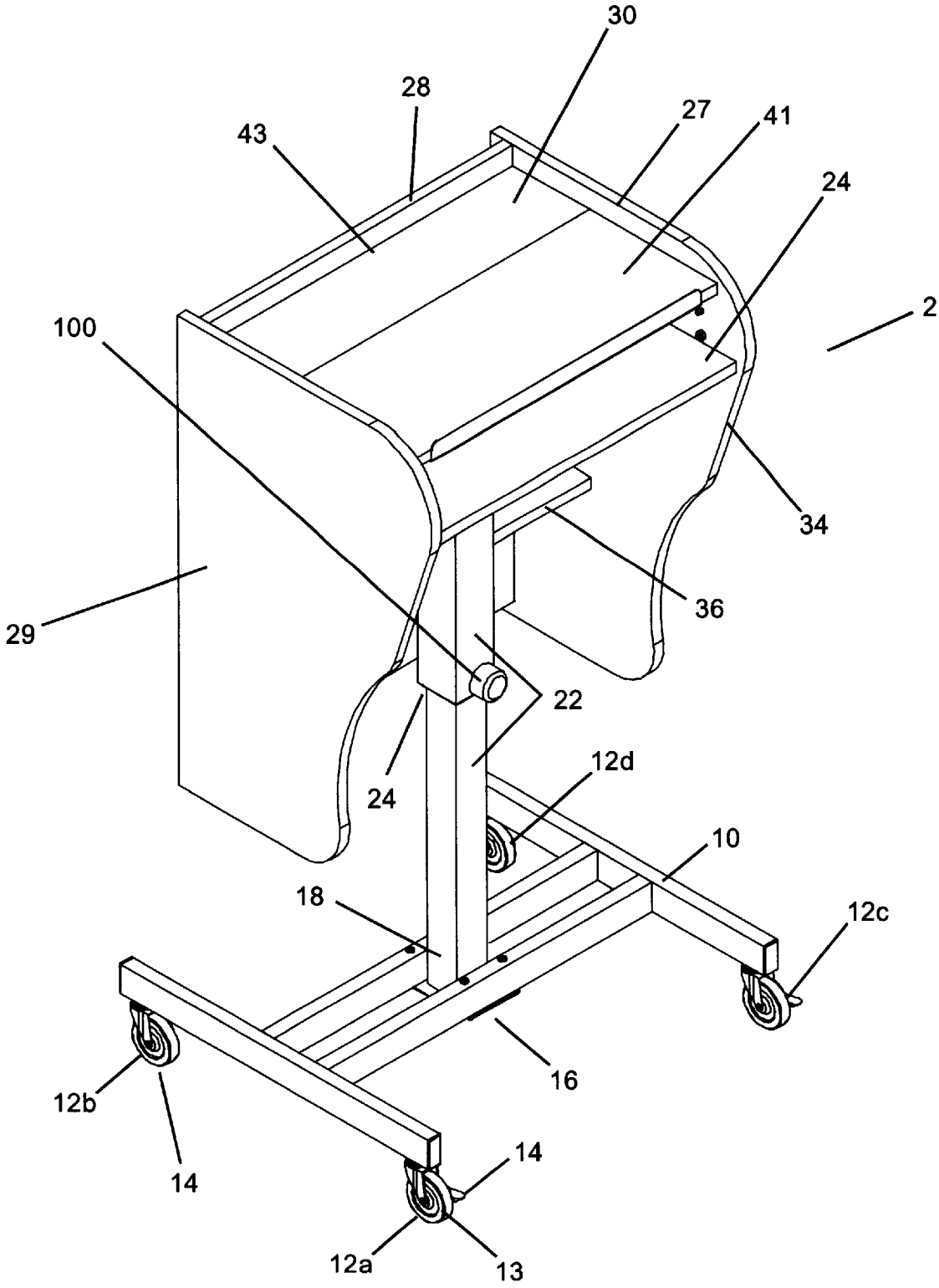
FIG. 1 is a perspective view of the pneumatic podium.

FIG. 1 shows the pneumatic podium having a base 10. The base 10 can be supported by two or more casters 12*a*, 12*b*, 12*c* and 12*d*, preferably 4 casters. One or more of the casters 12 may be locking using a caster locking means 14 or a switch or similar device.

The casters may have caster covers 13 on one or more of the caster wheels 12*a*, 12*b*, 12*c* and 12*d* shown in FIG. 1.

To this base 10, is secured a base plate 16, which attaches to the base 10 on the side closest to the floor. Passing through the base and secured to plate 16 is a column 18. Swivel movement of the podium is stopped by a locking pin. It is within the scope of the invention that the column could be rectangular square, or triangular or any angular or round shape.

Although the preferred embodiment has a base, which has the column passing through the base to attach to the plat, it is possible that the column is simply secured to the base if the base was constructed of a solid material.

Figure 2:
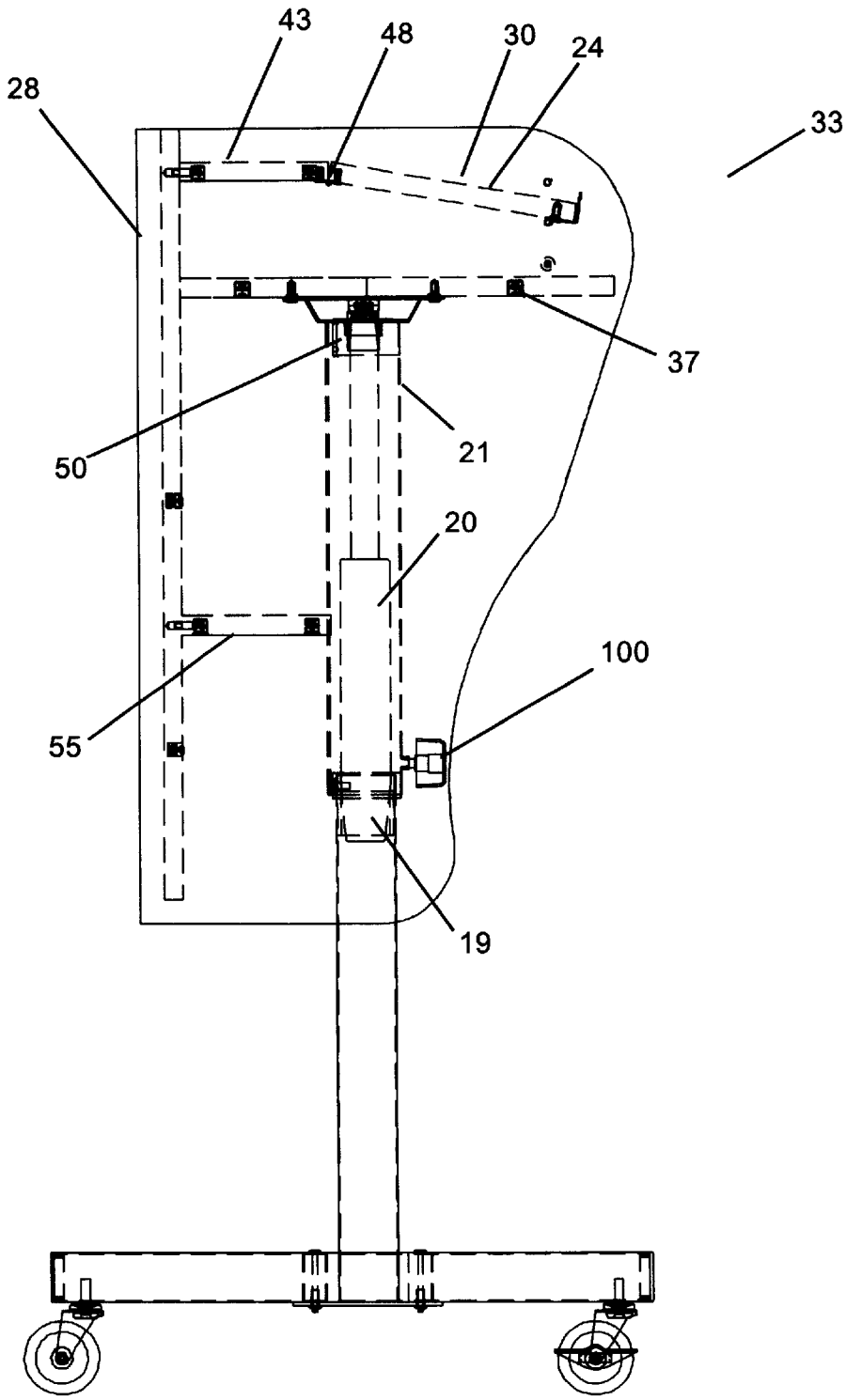
FIG. 2 is a sectional view of the pneumatic podium from the left side.
Figure 3:
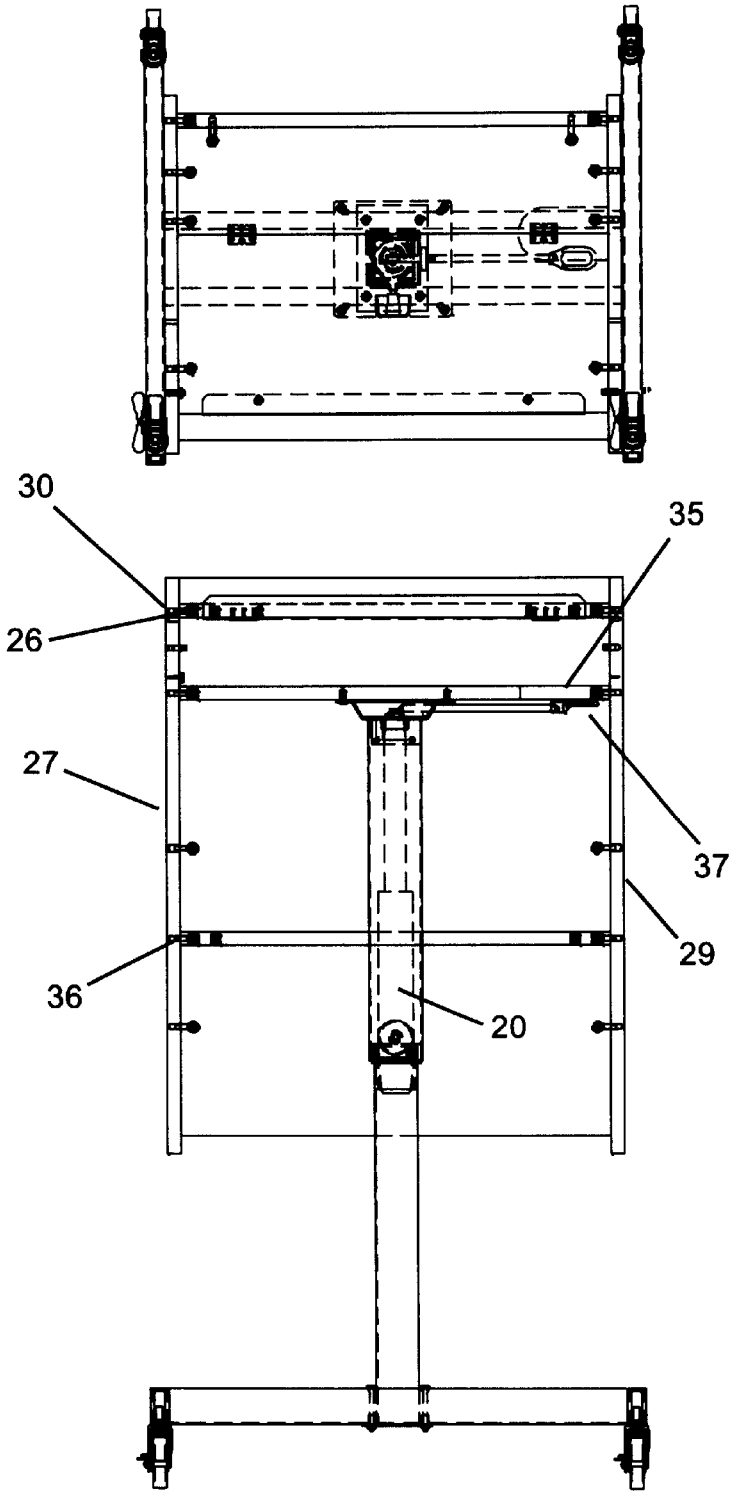
FIG. 3 is a way front view of the invention.

Inside the square column 18 is disposed a pneumatic cylinder 20, which is shown in FIG. 2 and FIG. 3.

Over the column 18 containing the pneumatic tube 20 a receiver tube 22 is disposed in a sliding relationship. The receiver tube is the same shape as the column. That is, if the column is triangular, the receiving tube must be triangular as well.

The tube 22 fits to a top mount assembly 24. The top mount assembly has numerous features including a top shelf 30. Top shelf 32 has a sloping portion 41 and a flat portion 43. The top shelf features are more clearly seen in FIG. 2. The sloping portion 41 is preferably secured to flat portion 43 with hinges 48 that are preferably piano hinges. A mid-shelf 26 can optionally be part of the top assembly as shown in FIG. 2 and FIG. 3. A bottom shelf 36 can optionally be added.

Figure 4:
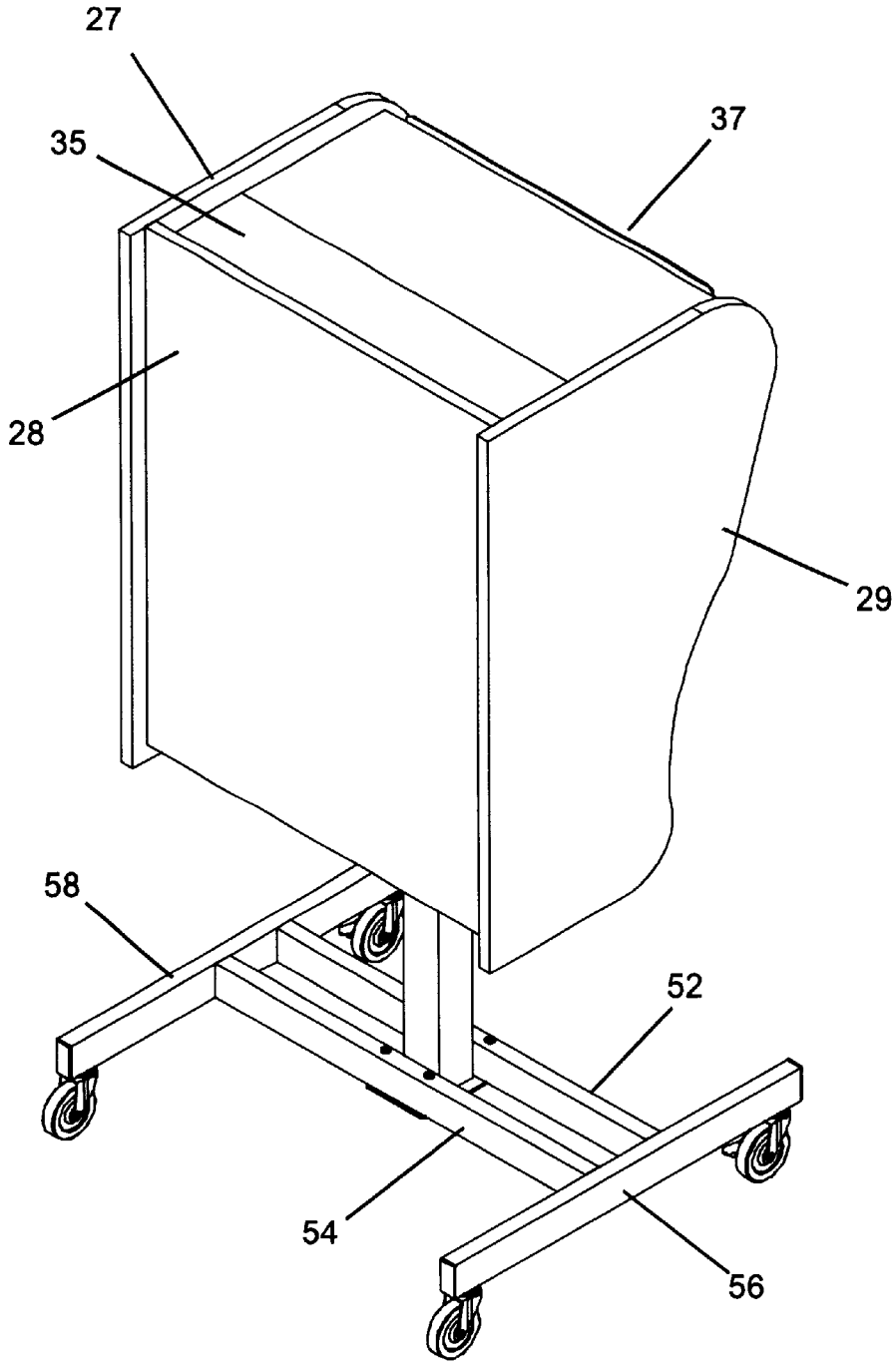
FIG. 4 is a front perspective view of the podium.

To the top shelf 30 is secured the front panel 28, which can be easily seen in FIGS. 2 and 4. The top mount assembly has four sides, a right side 27, a left side 29, a front side 31 to which the front panel 28 is secured and a speaker side 33. The top mount assembly also has a topside 35 and bottom side 37. Attached to bottom side 37 is a receiver tube engaging means 39, such as a plate with a geometric hole disposed in the plate to match the receiving tube, and the plate is secured to the bottom side 37 with conventional fasteners, such as threaded screws or similar attaching means.

The receiving tube preferably has a first end 19 and a second end 21 as shown in FIG. 2 located about midway between these ends is support means 55, which has a first end that secures to the receiving tube and a second end that attaches to the front panel 28.

The pneumatic piston 20 can be actuated by an actuator 50 shown in FIG. 2. Additionally when, after actuated, the piston raises the podium or lowers the podium to the desired height, cam locking means can be engaged to lock the height of the podium in place.

The locking pin 100 can be used to stop swivel action of the podium. The pin can be a threaded pin or a pin, which is frictionally fit into the tube.

The base of the podium can take any number of forms. The preferred embodiment is shown in the FIG. 3 as having generally "H" shape, wherein the base is shown in more detail FIG. 4, having a first base support 52 in parallel with a second base support. A third base support 56 is parallel to fourth base support 58. Base supports 56 and 58 are preferably attached to the ends of base supports 52 and 54 respectively. It is most preferred that this attachment occurs wherein base supports 52 and 54 are at right angles to base supports 58 and 56.

The overall height for an adult for the novel podium is considered to range from 1000 to 2000 cm in height and from 400 to 800 cm in width. The child's version of the podium will be smaller is geometric relation to a child's size. The depth of the podium would range from 300–500 cm. The most referred embodiment could be a podium 460 cm deep, 1300 cm high and 650 cm wide. The height to the bottom side of the top mount assembly would preferably be 1080 cm for this embodiment. The weight can range between 3 and 15 pounds.

It is contemplated that this invention could be made partially of metal for the base, column, tube, and plate and wood for the front panels and sides. It is with the scope of the invention that this could be an all-metal podium or an all-plastic podium, except for the pneumatic piston, which generally is metal.

This invention has been described in detail with particular reference to preferred embodiments thereof, but it will be understood that variations and modifications can be effected with scope and spirit of the invention.

What is claimed is:

1. A non-swiveling pneumatic podium comprising:

(a) a base;

(b) a column;

(c) a cam locking pneumatic cylinder disposed within said column;

(d) a receiver tube having a first tube end slidingly disposed over first end, and a second tube end;

(e) a top mount assembly having a right side, a left side, a front side, a speaker side, a top side, a bottom side, a receiver tube engaging means secured to said bottom side for fixedly connecting said receiver tube to said top mount assembly, a top shelf having a sloping portion and a flat portion, and wherein said sloping portion is secured to said top mount assembly;

(f) a front panel secured to said front side and said flat portion;

(g) a support means having a first part fixed to and extending from a position between said first tube end of said receiver tube and the second end of said receiving tube to a second part secured to said front panel;

(h) a left panel secured to said left side and to said front panel;

(i) a right panel secured to said right side and said front panel;

(j) an actuation means for engaging said pneumatic cylinder;

(k) a locking means for locking said podium at a desired height once said pneumatic cylinder is engaged;

(l) a locking pin for arresting swiveling movement of said receiver tube; and (m) wherein all components other than the pneumatic cylinder are made of plastic so that the weight of the podium is between 3 and 15 pounds.

2. The podium of claim 1, wherein said base consists of:

(a) a first base support which is parallel to a second base support;

(b) a third base support which is parallel to a fourth base support and wherein said third and fourth base supports are transverse to said first and second base supports.

3. The podium of claim 1, wherein said base is on at least two casters.

4. The podium of claim 3, wherein at least one of said casters is locking.

5. The podium of claim 1, wherein said receiver tube engaging means is a plate having a hole for receiving the column.

6. The podium of claim 5, further comprising a tube closure disposed around said receiver tube for further supporting said podium.

7. The podium of claim 1, wherein said top shelf is secured to said top side of said top mount assembly with at least one piano hinge.

8. The podium of claim 1, further comprising additional shelving means positioned beneath said top mount assembly and each secured on one side to said front panel.

9. The podium of claim 8, wherein said additional shelving consists of a mid-shelf and a bottom shelf.

10. The podium of claim 1, where said podium has a height between 100 and 200 cm.

11. The podium of claim 1, wherein the receiver tube is square.

* * * * *